US009840669B2

(12) United States Patent
Kuznetsov et al.

(10) Patent No.: US 9,840,669 B2
(45) Date of Patent: Dec. 12, 2017

(54) METHODS OF RECOVERING BITUMEN FROM OIL SANDS

(71) Applicant: Baker Hughes Incorporated, Houston, TX (US)

(72) Inventors: Oleksandr V. Kuznetsov, Sugar Land, TX (US); Valery N. Khabashesku, Houston, TX (US); Oleg A. Mazyar, Katy, TX (US); Devesh Kumar Agrawal, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 644 days.

(21) Appl. No.: 14/296,857

(22) Filed: Jun. 5, 2014

(65) Prior Publication Data

US 2015/0353836 A1 Dec. 10, 2015

(51) Int. Cl.
*C10G 1/04* (2006.01)
*B03D 1/018* (2006.01)
(Continued)

(52) U.S. Cl.
CPC ..... *C10G 1/047* (2013.01); *B03D 1/018* (2013.01); *B03D 1/02* (2013.01); *C10G 1/04* (2013.01);
(Continued)

(58) Field of Classification Search
CPC ..... C10G 1/04; C10G 1/047
See application file for complete search history.

(56) References Cited

U.S. PATENT DOCUMENTS 4,946,597 A 8/1990 Sury
7,867,382 B2 1/2011 Droughton
(Continued)

FOREIGN PATENT DOCUMENTS

CA 2098622 A1 12/1994
CA 2682109 C 1/2011
(Continued)

OTHER PUBLICATIONS

Ghorai et al., Evaluation of the Flocculation Characteristics of Polyacrylamide Grafted Xanthan Gum/Silica Hybrid Nanocomposite, Industrial & Engineering Chemistry Research, vol. 52, (2013), pp. 9731-9740.
(Continued)

*Primary Examiner* — Renee Robinson
(74) *Attorney, Agent, or Firm* — TraskBritt

(57) ABSTRACT

A flocculant, according to embodiments of the present disclosure, includes a core nanoparticle and at least one positively charged functional group on a surface of the core nanoparticle. The nanoparticle may comprise a silica, alumina, titania, iron oxide, iron nitride, iron carbide, or a carbon-based nanoparticle. The flocculant may be used, in a method of bitumen recovery, to neutralize and agglomerate bitumen droplets and/or mineral particles derived from oil sands ore. The bitumen droplets agglomerate about the core nanoparticle of the flocculant to form bitumen flocs, while the mineral particles agglomerate about the core nanoparticle of the flocculant to form mineral flocs. The buoyant bitumen flocs may then separate from the dense mineral flocs to enable high-yield recovery of bitumen from oil sands.

20 Claims, 2 Drawing Sheets

(51) Int. Cl.

| | |
|---|---|
| ***B03D 1/02*** | (2006.01) |
| *B03D 1/01* | (2006.01) |
| *B03D 1/012* | (2006.01) |
| *B03D 1/014* | (2006.01) |
| *B03D 1/016* | (2006.01) |

(52) U.S. Cl.

CPC ..... *C10G 1/045* (2013.01); *B03D 1/01* (2013.01); *B03D 1/011* (2013.01); *B03D 1/012* (2013.01); *B03D 1/014* (2013.01); *B03D 1/016* (2013.01); *B03D 2201/002* (2013.01); *B03D 2203/006* (2013.01); *Y10T 428/2982* (2015.01)

(56) References Cited

U.S. PATENT DOCUMENTS

| | | | | |
|---|---|---|---|---|
| 8,092,774 | B2 | 1/2012 | Khabashesku et al. | |
| 8,343,337 | B2 | 1/2013 | Moffett et al. | |
| 8,388,832 | B2 | 3/2013 | Moffett et al. | |
| 8,420,717 | B2 | 4/2013 | Khabashesku et al. | |
| 8,454,821 | B2 | 6/2013 | Chakrabarty et al. | |
| 8,616,272 | B2 | 12/2013 | Mazyar et al. | |
| 2003/0220204 | A1* | 11/2003 | Baran, Jr. ..... | B82Y 30/00 507/200 |
| 2006/0272983 | A1 | 12/2006 | Droughton et al. | |
| 2010/0101981 | A1* | 4/2010 | Moffett ..... | C04B 28/24 208/391 |
| 2010/0104744 | A1 | 4/2010 | Moffett | |
| 2011/0210044 | A1 | 9/2011 | Chakrabarty et al. | |
| 2011/0253599 | A1 | 10/2011 | Cross et al. | |
| 2012/0255887 | A1* | 10/2012 | Holms ..... | C10G 1/047 208/390 |
| 2012/0324799 | A1 | 12/2012 | Chakraborty et al. | |
| 2013/0140240 | A1 | 6/2013 | Mazyar | |
| 2013/0149447 | A1 | 6/2013 | Mazyar et al. | |
| 2013/0240210 | A1 | 9/2013 | Yale et al. | |
| 2013/0334100 | A1 | 12/2013 | Mazyar et al. | |

FOREIGN PATENT DOCUMENTS

| | | | |
|---|---|---|---|
| WO | 2012088291 | A1 | 6/2012 |
| WO | 2012136064 | A1 | 10/2012 |

OTHER PUBLICATIONS

Li et al., Synergetic Role of Polymer Flocculant in Low-Temperature Bitumen Extraction and Tailings Treatment, Energy & Fuels, vol. 19, (2005), pp. 936-943.

Wu et al., Functionalization of Carbon Nanotubes by an Ionic-Liquid Polymer: Dispersion of Pt and PtRu Nanoparticles on Carbon Nanotubes and Their Electrocatalytic Oxidation of Methanol, Angewandte Chemie International Edition, vol. 48, No. 26, (2009), pp. 4751-4754.

Anonymous, Aminated Silica Nanospheres and Microspheres, Microspheres-Nanospheres, <http://www.microspheres-nanospheres.com/Microspheres/Inorganic/Silica/SiO2%20amino.htm>, (visited Jun. 3, 2014), 4 pages.

Anonymous, Amorphous Products | Nanoscale Products—Surface-Modified Nanoparticles, Nanostructured & Amorphous Materials, Inc., <http://www.nanoamor.com/_surface_modified_nanoparticles>, (visited May 17, 2014), 1 page.

Anonymous, Silicon Oxide Nanoparticles, SkySpring Nanomaterials, Inc., <http://ssnano.com/inc/sdetail/silicon_oxide_nanoparticles/363>, (visited May 17, 2014), 1 page.

* cited by examiner

METHODS OF RECOVERING BITUMEN FROM OIL SANDS

FIELD

Embodiments of the present disclosure relate to bitumen extraction. More particularly, embodiments of the present disclosure relate to flocculants and methods for recovering bitumen from mined oil sands.

BACKGROUND

Oil sands, which may also be known in the art as "tar sands" or "bituminous sands," are a type of petroleum deposit. Oil sands comprise mineral particles (e.g., clays and/or sand) along with connate water and bitumen. Bitumen is a mixture of hydrocarbons, and, once recovered from the oil sands, may be refined for further use, as with other petroleum product refining. Economically recovering bitumen from oil sands, however, often poses challenges.

Flotation is a common technique used to recover bitumen from oil sand ore. In flotation, oil sand ore, water, and possible other additives are fed to a flotation cell in which the materials are agitated and air is bubbled through. The vigorous mechanical agitation and the aeration from the bubbled air, along with the influence of possible chemical additives and temperature, disrupts the granules of the oil sand ore, causing the bitumen to separate from the mineral particles (e.g., clays and/or sand particles) of the oil sand ore. Once separated, the bitumen may come into contact with the air bubbles, which urge the bitumen droplets upward to form a bitumen-rich froth. The froth "floats" or rises to form a phase that is separable from a "middlings" layer, comprising residual bitumen and suspended mineral particles, and a bottom layer, comprising water and mineral "fines" that have settled due to gravity. Obtaining a good yield of bitumen product from the oil sands is desired to minimize costs and wastes of the flotation process.

Efforts have been made to increase the yield of bitumen recovery by adding one or more flocculants to the slurry in the flotation cell. Flocculants are generally configured to encourage particles dispersed in the slurry to form larger-sized clusters, generally known in the art as "flocs" or "flakes," that may either rise to the froth layer or sink to the bottom layer. Formulating flocculants and designing bitumen recovery systems that achieve maximum yield of bitumen recovery from oil sands continues to present challenges.

BRIEF SUMMARY

In some embodiments, the present disclosure includes a flocculant for bitumen recovery. The flocculant comprises a core nanoparticle selected from the group consisting of silica nanoparticles, alumina nanoparticles, titania nanoparticles, iron oxide nanoparticles, iron nitride nanoparticles, iron carbide nanoparticles, and carbon-based nanoparticles. At least one functional group is on a surface of the core nanoparticle. The functional group is positively charged.

The disclosure also includes embodiments of a method for separating bitumen from oil sands, which method comprises forming a slurry comprising oil sands and water. The oil sands comprise bitumen and a solid material. The slurry is contacted with flocculant particles in the presence of bubbled air to form a froth comprising the bitumen and at least an amount of the flocculant particles. Each of the flocculant particles comprises a nanoparticle having at least one positively charged functional group disposed on a surface of the nanoparticle. The froth is separated from at least one other phase comprising the water and the solid material.

In some embodiments, a method for recovering bitumen from oil sands comprises agitating an aqueous mixture comprising oil sands to form a suspension comprising bitumen droplets and mineral particles suspended in water. Solid particles of a flocculant are dispersed into the suspension. The solid particles of the flocculant each have a core surface occupied by positively charged functional groups. The positively charged functional groups neutralize a negative charge of the bitumen droplets and form flocs comprising at least some of the bitumen droplets proximate the core surface of at least some of the solid particles of the flocculant. A gas is bubbled into the suspension to form a froth comprising the gas and the flocs.

BRIEF DESCRIPTION OF THE DRAWINGS

While the specification concludes with claims particularly pointing out and distinctly claiming what are regarded as embodiments of the disclosure, various features and advantages of this disclosure may be more readily ascertained from the following description of example embodiments provided with reference to the accompanying drawings, in which:

DETAILED DESCRIPTION

Figure 1:
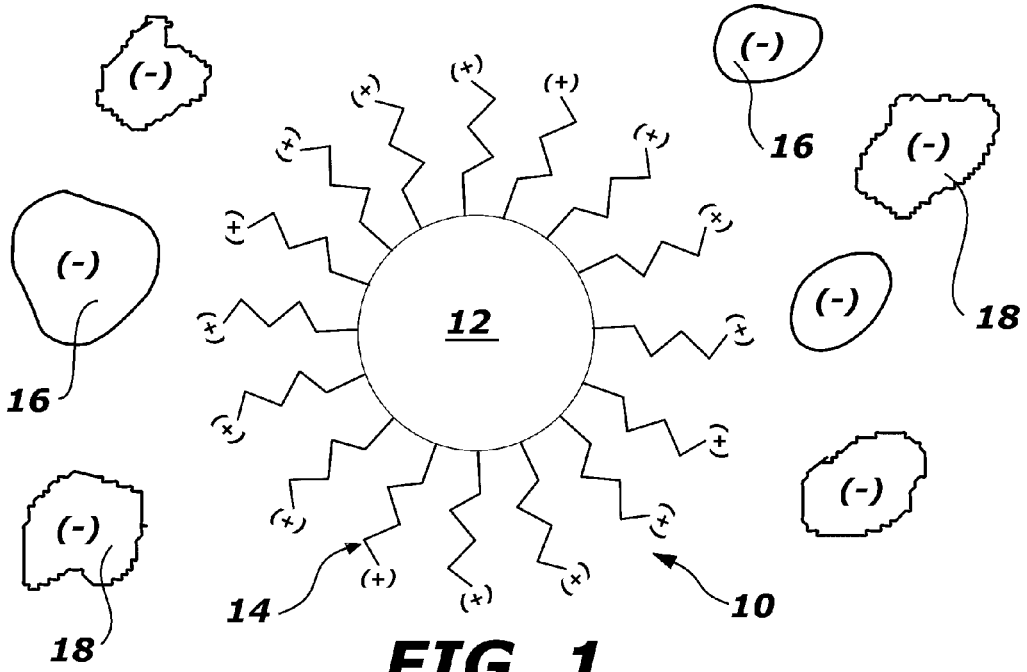
FIG. 1 is a cross-sectional, simplified diagram of a flocculant particle according to an embodiment of the present disclosure, in an environment comprising particles of bitumen and mineral material.

The illustrations presented herein are not actual views of any particular material or system, but are merely idealized representations that are employed to describe embodiments of the present disclosure.

Flocculants and systems described herein may enable recovery of bitumen from oil sand ore, e.g., using flotation. The flocculants include a core nanoparticle that may be surface-treated with a cationic surfactant, an ionic liquid surfactant, a polymerizable ionic liquid surfactant, an ionic liquid polymer, and/or functionalized. Thus, the flocculants are formulated to have positively charged functional groups covalently or non-covalently attached to a surface of a core nanoparticle. The flocculant is added to the slurry of oil sands and water in the flotation cell, and the positive charge on the flocculant neutralizes a negative charge on at least one of droplets of bitumen and mineral particles. The neutralization of the droplets of bitumen and the mineral particles enables the particles to agglomerate with one another and with the flocculant to form flakes of a larger size than would otherwise be achievable without the neutralization. For example, the bitumen droplets may agglomerate about the particles of flocculant, to form bitumen flocs with dense, nanoparticle cores. Likewise, the mineral particles may agglomerate about the particles of flocculant, to form mineral flocs with dense, nanoparticle cores. The bitumen flocs and the mineral flocs may then come into contact with gas bubbled into the cell, which gas may then carry the bitumen flocs to the froth layer while the mineral flocs sink to a bottom layer. The yield of bitumen from the oil sands ore recovered in the froth layer may be greater, due to the addition of the positively charged flocculant, than would be achieved without the addition of the flocculant. After the middlings layer has been separated from the other layers (e.g., the froth and the bottom layer), an additional amount of flocculant may be added to treat the middlings layer to enable additional recovery of bitumen from the middlings, which additional recovery may increase the overall yield of bitumen recovered. Likewise, after the bottom layer has been separated from the other layers (e.g., the froth and the middlings layer), additional flocculant may be added to treat the bottom layer to promote separation of water from settling mineral material.

As used herein, the term "flocculant" means and includes a material formulated to promote neutralization of charge on particles of another material to enable the particles of the another material to come close together and form larger clumps, referred to herein as "flocs" or "flakes."

As used herein, the terms "floc" and "flake" may be used interchangeably and mean and include an agglomeration comprising at least a nanoparticle derived from a flocculant and a plurality of droplets or particles derived from oil sand ore. For example, and without limitation, depending on the context in which the term is used, a "flake" may comprise a silica nanoparticle, derived from a silica-based flocculant, and droplets of bitumen, derived from oil sand ore, agglomerated to the silica nanoparticle.

As used herein, the term "fines" means and includes small particles of mineral material, such as sand and clay, which small particles are passable through a 325 mesh screen.

As used herein, the term "froth" means and includes an upper (e.g., most buoyant) layer produced by a flotation cell, which upper layer includes gas bubbled into the flotation cell and at least one material separated from at least one other material. For example, and without limitation, a "froth" layer, according to embodiments of the present disclosure, may include air, bitumen droplets, and flocs of bitumen droplets and flocculant.

As used herein, the term "middlings" means and includes a middle layer produced by a flotation cell, which middle layer includes a mixture comprising relatively non-buoyant bitumen droplets and fines.

As used herein, the term "bottom layer" means and includes a lowest (e.g., least buoyant) layer produced by a flotation cell, which lowest layer includes at least one material separated from at least one other material generally recovered in the froth layer. For example, and without limitation, a "bottom layer," according to embodiments of the present disclosure, may include water, mineral particles, and flocs of mineral particles and flocculant.

As used herein, the term "particle" refers to a mass of either liquid or solid material. For example, and without limitation, a "particle" may include both droplets of a liquid material and grains of a solid material.

As used herein, the term "nanoparticle" means and includes any particle, such as, for example, a crystal or grain, having an average particle diameter of between about 1 nm and about 100 nm.

With reference to FIG. 1, a cross-sectional view of a flocculant particle 10 is shown. The flocculant particle 10 includes at least one core nanoparticle 12, which may be surface-modified to exhibit a net positive charge. Thus, a net negative charge may be imparted to the periphery of the flocculant particle 10. For example, the surface of the core nanoparticle 12 may be modified to covalently or, alternatively, non-covalently attach thereto at least one functional group 14 that is positively charged at at least one terminal end. While FIG. 1 illustrates the functional groups 14 as a single, non-branching chain terminating at a positive charge, the functional groups 14 may be alternatively formulated to provide the positive charge proximate to the surface of the core nanoparticle (e.g., without an extending chain), to provide branching chains with multiple branches thereof terminating in positive charges, and/or with a mix of functional groups 14 rather than only one functional group composition used. In any case, the flocculant particle 10 effectively has a positively charged exterior surface due to the presence of the positive-charged terminated functional groups 14.

Without being limited to any one theory, it is contemplated that, in a conventional flotation cell of a bitumen recovery system, in which oil sands are agitated in water, bitumen droplets 16 and/or mineral particles 18 (e.g., clay particles, sand particles), derived from the oil sands, may have negative surface charges. That is, the bitumen droplets 16 and the mineral particles 18, derived from oil sands ore, may tend to be negatively charged. The similar surface charges tend to repel the bitumen droplets 16 and the mineral particles 18 from one another, which inhibits the bitumen droplets 16 and the mineral particles 18 from agglomerating. Remaining in suspension as separated, small particles, the bitumen droplets 16 and the mineral particles 18 may be less likely to separate into different phases, such as the froth layer and the middlings or bottom layer, in the flotation cell even with air bubbled through the cell. Therefore, recovery of bitumen from the slurry is inhibited.

According to embodiments of the present disclosure, however, flocculant particles 10, with their positively charged surfaces, may be introduced to the slurry of the flotation cell to neutralize the negative charges of the bitumen droplets 16 and the mineral particles 18. The charge neutralization enables the bitumen droplets 16 to agglomerate with one another and with the flocculant particles 10 and also enables the mineral particles 18 to agglomerate with one another and with the flocculant particles 10. It is contemplated that the bitumen droplets 16, which tend to be more buoyant than the mineral particles 18, will tend to agglomerate with one another and with the flocculant particles 10, rather than with the mineral particles 18. Thus, flocs of bitumen droplets 16 and/or flocs of bitumen droplets 16 and flocculant particles 10 may form (collectively referred to herein as "bitumen flocs") while flocs of mineral particles 18 and/or flocs of mineral particles 18 and flocculant particles 10 may also form (collectively referred to herein as "mineral flocs").

The core nanoparticles 12 of the flocculant particles 10 may be, for example, at least one of silica (e.g., silicon dioxide ($SiO_2$)) nanoparticles, alumina (e.g., aluminum oxide ($Al_2O_3$)) nanoparticles, titania (e.g., titanium dioxide ($TiO_2$) nanoparticles, iron oxide ($Fe_xO_y$, wherein x is, e.g., between 1 and 4, and y is, e.g., between 1 and 5) nanoparticles, iron nitride nanoparticles, iron carbide nanoparticles, and carbon-based (e.g., diamond, graphene, graphene oxide, carbon nanotube, fullerene, carbon onion-like structures (e.g., a "bucky onion"), carbon) nanoparticles. In some embodiments, the core nanoparticles 12 may have an average particle diameter of between less than about 50 nm, e.g., about 20 nm.

The functional groups 14 occupying the surface of the core nanoparticles 12 may be formulated to have the positive charge on a terminal end, i.e., an end distal to the surface of the core nanoparticles 12. The functional groups 14 may include one or more of primary, secondary, and tertiary amine groups, amide groups, quaternary ammonium groups, quaternary phosphonium groups, tertiary sulphonium groups, pyridinium groups, imidazolium groups, polyethylenimine (PEI) groups, and soluble polymers terminated with amine (e.g., polyethylene oxide terminated with amine).

As a particular example, without limitation, in some embodiments, the flocculant particles 10 may be particles of aminated silica. For example, silicon oxide nanoparticles surface modified with amino groups, having average particle diameters between about 10 nm and about 20 nm are commercially available as product 6851HN from SkySpring Nanomaterials, Inc., of Houston, Tex. Aminated silica is also commercially available under the Dow Corning product name Z-6011 from Nanostructured & Amorphous Materials, Inc. (also known as NanoAmor), of Houston, Tex. Aminated silica is also commercially available from Microspheres-Nanospheres, a Corpuscular company, Cold Spring, N.Y.

As another particular example, without limitation, in some embodiments, the flocculant particles 10 may be carbon nanotubes functionalized with polymerizable ionic liquids, as described by Wu et al., in "Functionalization of Carbon Nanotubes by an Ionic-Liquid Polymer: Dispersion of Pt and PtRu Nanoparticles on Carbon Nanotubes and Their Electrocatalytic Oxidation of Methanol," Angewandte Chemie International Edition 48, No. 26 (2009): 4751-4754, the contents of which is incorporated herein, in its entirety, by reference.

In some embodiments, such as that illustrated in FIG. 1, essentially the whole of the surface of the core nanoparticle 12 of the flocculant particle 10 may be occupied by the positive-charge terminated functional groups 14. In other embodiments, a portion of the surface of the core nanoparticle 12 may be occupied by the positive-charge terminated functional groups 14.

Because the flocculant particle 10 may be formulated to have a nanoparticle of solid material at its core, with functional groups 14 disposed around the core, when the flocculant particle 10 interacts with bitumen droplets 16 or with the mineral particles 18, the bitumen droplets 16 or the mineral particles 18 may agglomerate, spherically, around the nanoparticle of solid material, forming a floc with a dense center. Such dense-centered flocs may tend to be larger and more stable than flocs formed using conventional flocculants formulated as polymer chains to which target particles may agglomerate along the chain. That is, the dense-centered flocs may be less apt to break apart in the face of the shear stresses of the mixing slurry in a flotation cell, than polymer-chain-centered flocs formed by conventional flocculants. The increased size and stability of the dense-centered flocs may enable more efficient separation of bitumen flocs from mineral flocs.

Accordingly, disclosed is a flocculant for bitumen recovery. The flocculant comprises a core nanoparticle selected from the group consisting of silica nanoparticles, alumina nanoparticles, titania nanoparticles, iron oxide nanoparticles, iron nitride nanoparticles, iron carbide nanoparticles, and carbon-based nanoparticles. At least one functional group is on the surface of the core nanoparticle. The at least one functional group is positively charged.

Figure 2:
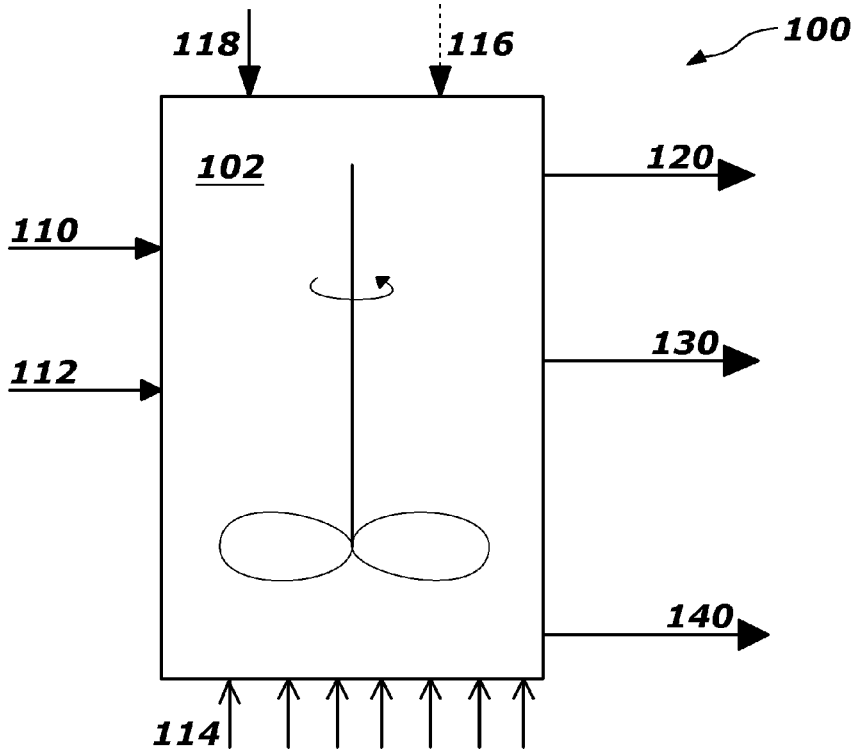
FIG. 2 is an elevational diagram of a single-cell bitumen recovery system according to an embodiment of the present disclosure.

With reference to FIG. 2, illustrated is a single-cell bitumen recovery system 100 in which the flocculant particles 10 of FIG. 1 may be utilized to enable efficient recovery of bitumen from oil sands ore in a flotation cell 102. A slurry is formed by introducing a feed 110 comprising oil stands sands ore (e.g., crushed oil sands ore) to water 112, which are mixed together. Though FIG. 2 illustrates the feed 110 and the water 112 added to the flotation cell 102 as separate feeds, in other embodiments, the feed 110 of oil sands ore and the water 112 may be joined together, and mixed, before being introduced to the flotation cell 102. Air 114 is bubbled (as indicated by the vertical directional arrows shown in FIG. 2) into the flotation cell 102 as the slurry is agitated. The agitation may disrupt granules of the oil sands ore such that bitumen droplets 16 (FIG. 1) and mineral particles 18 (FIG. 1) may begin to separate from the oil sands ore. Optionally, additional material 116 may be added to the flotation cell 102. Such additional material 116 may include surfactants or other chemicals formulated to promote mixing, separation, pH control, or other characteristics control during operation of the flotation cell 102.

Flocculant 118, which may be in the form of a solid powder of the flocculant particles 10 described above regarding FIG. 1, may be added to the slurry in the flotation cell 102. The positive-charge of the flocculant 118 may neutralize the negative charges of the bitumen droplets 16 (FIG. 1) and the negative charges of the mineral particles (18) to form bitumen flocs (e.g., flocs of agglomerating bitumen, flocs of bitumen agglomerating about the core nanoparticle 12 of the flocculant particles 10) and mineral flocs (e.g., flocs of agglomerating minerals, flocs of minerals agglomerating about the core nanoparticle 12 of the flocculant particles 10). The increased size and surface area of the buoyant, bitumen flocs, compared to the individual bitumen droplets 16 (FIG. 1), may enable the bitumen flocs to interact with bubbles from the bubbled air 114 and to be carried up to form a froth 120 comprising the air 114 and the bitumen flocs, with at least some of the flocculant 118. At the same time, the increased size and density of the mineral flocs, compared to the individual mineral particles 18, may enable the mineral flocs to sink to a bottom layer 140. In addition to the mineral flocs, which may include some of the flocculant 118, the bottom layer 140 may also include water from the water 112 input. A middlings layer 130 may also be formed and may comprise some water from the water 112 input and fines (i.e., not-yet-agglomerated) of the mineral particles 18 and/or bitumen droplets 16 (FIG. 1). The separated phases, i.e., the froth 120, the middlings layer 130, and the bottom layer 140 may be separately removed from the flotation cell 102, such that the bitumen in the froth 120 is recovered from the oil sands ore introduced in the feed 110.

The presence of the flocculant 118, with its positive charge about core nanoparticles 12 (FIG. 1), may enable a higher yield of bitumen recovery from the oil sands ore of the feed 110 than would be achievable without using a flocculant or with use of a conventional flocculant lacking a dense core nanoparticle 12 (FIG. 1). The use of the flocculant 118 may also promote faster separation of the bitumen and the mineral materials, from the oil sands ore, than would be achievable without using a flocculant or with use of a conventional flocculant.

Accordingly, disclosed is a method for separating bitumen from oil sands. The method comprises forming a slurry comprising oil sands and water. The oil sands comprise bitumen and a solid material. The slurry is contacted with flocculant particles in the presence of bubbled air to form a froth comprising the bitumen and at least an amount of the flocculant particles. Each of the flocculant particles comprises a nanoparticle having at least one positively charged functional group covalently or non-covalently disposed on a surface of the nanoparticle. The froth is separated from at least one other phase comprising the water and the solid material.

Figure 3:
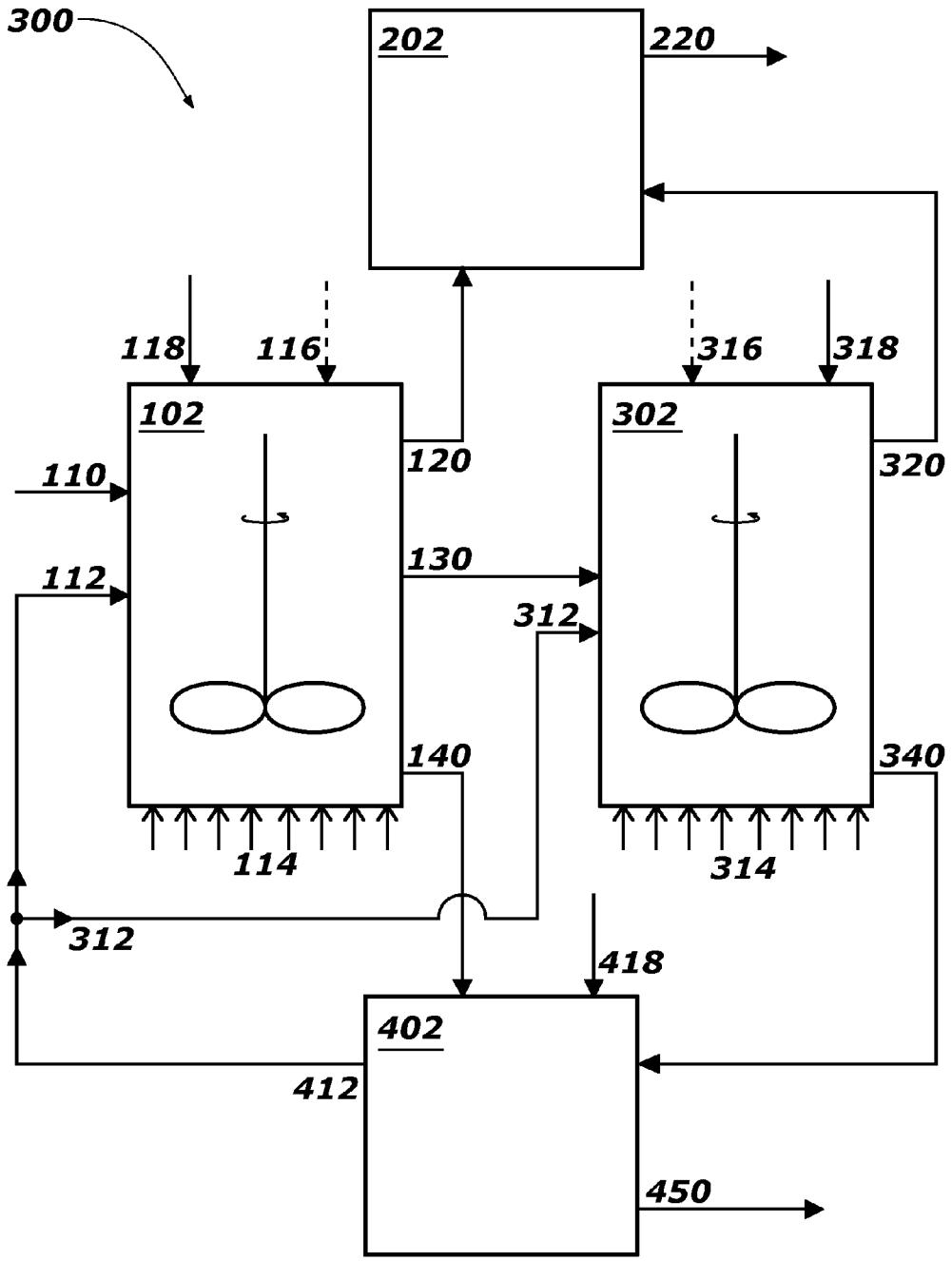
FIG. 3 is an elevational diagram of a multi-cell bitumen recovery system according to an embodiment of the present disclosure.

With reference to FIG. 3, in some embodiments, a multi-cell bitumen recovery system 300 may be utilized. For example, the middlings 130 from a primary flotation cell, e.g., the flotation cell 102 of FIG. 2 (hereinafter referred to, in the context of the system 300 of FIG. 3 as the "primary flotation cell 102") may be fed to a secondary flotation cell 302 along with, optionally, another water feed 312, bubbled air 314, and, optionally, additional material 316 such as surfactants, etc. Because the middlings 130 from the primary flotation cell 102 may include bitumen and mineral fines that may not yet have agglomerated and/or that may still be negatively charged, additional flocculant 318 may be fed to the secondary flotation cell 302. As with in the primary flotation cell 102, the additional flocculant 318 may be added in the form of a powder of the flocculant particles 10 (FIG. 1). In the secondary flotation cell 302, the remaining bitumen may be neutralized by the positive charged flocculant particles 10 and may agglomerate together and/or with the flocculant particles 10 to form buoyant bitumen flocs that may be carried up, by the bubbled air 314, to form a secondary froth 320. At the same time, the remaining mineral grains 18 (FIG. 1) may be neutralized by the positive charged flocculant particles 10 and may agglomerate together and/or with the flocculant particles 10 to form dense-centered mineral flocs that may fall away to a secondary bottom layer 340. The use of the flocculant particles 10 (FIG. 1) in the flocculant 318 added to the slurry in the secondary flotation cell 302 may enable a higher yield of bitumen recovery in the froth 320 than may be achievable without use of the flocculant 318 or with use of a conventional flocculant lacking the dense center.

The froth 120 from the primary flotation cell 102 and the froth 320 from the secondary flotation cell 320 may be collected, e.g., in a container 202, to provide a bitumen output 220 that includes bitumen recovered from the oil sands ore introduced to the system 300 in the feed 110. Some of the flocculant particles 10, from the flocculant feeds 118, 318, may also be included in the bitumen output 220. It is contemplated that, in some embodiments, the amount of flocculant particles 10 added to each of the flotation cells 102, 302 may constitute about 100 ppm (about 100 parts per million) or less in the slurry in the flotation cells 102, 302. Therefore, the amount of flocculant 10 in the bitumen output 220 may be minimal and may not necessitate separation of the bitumen from the flocculant 10 before additional processing. However, in other embodiments, the bitumen output 220 may be further treated to separate the bitumen and the flocculant 10.

The bottom layer 140 from the primary flotation cell 102 and the bottom layer 340 from the secondary flotation cell 302 may also be collected, e.g., in a container 402, wherein the mineral flocs may separate from the water due to, e.g., gravity. An additional flocculant feed 418 may be added to promote the separation of the mineral material and the water. The separated solids 450 may be output to, e.g., a tailings pond while the recovered water 412 may be returned in the system 300 as, e.g., part or all of the water feed 112 to the primary flotation cell 102 and the water feed 312 to the secondary flotation cell 302.

Because the mineral flocs may include mineral particles agglomerated about a core nanoparticle 12 of a flocculant particle 10, the separated solids 450 may also include some flocculant particles 10. In some embodiments, the separated solids 450 may not be further treated to remove the remaining flocculant particles 10. However, in other embodiments, additional treatment may be used to remove the flocculant particles 10 from the separated solids 450 before the solids are added to, e.g., a tailings pond. For example, in embodiments in which the core nanoparticles 12 of the flocculant particles 10 are nanosilica particles, recovery of the core nanoparticles 12, or the entire flocculant particles 10, from the separated solids 450 may not be necessary or economically desirable. However, in embodiments in which the core nanoparticles 12 of the flocculant particles 10 are nanodiamond, recovery of the core nanoparticles 12, or the entire flocculant particles 10, from the separated solids 450 may be economically desirable.

In embodiments in which only the core nanoparticles 12 are recovered in the system 300, the core nanoparticles 12 may be surface modified, again, to occupy the surface thereof with positive-charged terminated functional groups 14 (FIG. 1) before the flocculant particles 10 are re-introduced to the system 300 in any of the flocculant feeds 118, 318, 418.

Accordingly, disclosed is a method for recovering bitumen from oil sands. The method comprises agitating an aqueous mixture comprising oil sands to form a suspension comprising bitumen droplets and mineral particles suspended in water. Solid particles of flocculant are dispersed into the suspension. The solid particles of the flocculant each have a core surface occupied by positively charged functional groups, and the dispersed flocculant neutralizes a negative charge of the bitumen droplets and forms flocs comprising at least some of the bitumen droplets proximate the core surface of at least some of the solid particles of the flocculant. A gas is bubbled into the suspension to form a froth comprising the gas and the flocs.

Additional non-limiting example embodiments of the disclosure are described below.

Embodiment 1

A flocculant for bitumen recovery, comprising: a core nanoparticle selected from the group consisting of silica nanoparticles, alumina nanoparticles, titania nanoparticles, iron oxide nanoparticles, iron nitride nanoparticles, iron carbide nanoparticles, and carbon-based nanoparticles; and at least one functional group on a surface of the core nanoparticle, the at least one functional group being positively charged.

Embodiment 2

The flocculant of Embodiment 1, wherein the core nanoparticle has a diameter of less than about 50 nm.

Embodiment 3

The flocculant of any one of Embodiments 1 and 2, wherein the core nanoparticle is a carbon-based nanoparticle selected from the group consisting of nano-diamonds, carbon nano-tubes, fullerenes, carbon onion-like structures, graphene, and graphene oxide.

Embodiment 4

The flocculant of any one of Embodiments 1 through 3, wherein the at least one functional group is selected from the group consisting of primary, secondary, and tertiary amine groups, amide groups, quaternary ammonium groups, quaternary phosphonium groups, tertiary sulphonium groups, pyridinium groups, imidazolium groups, polyethylenimine (PEI) groups, and soluble polymers terminated with amine.

Embodiment 5

The flocculant of any one of Embodiments 1 and 2, wherein the core nanoparticle is a silica nanoparticle; and the at least one functional group comprises an amine group.

Embodiment 6

The flocculant of any one of Embodiments 1 through 5, wherein the at least one functional group comprises a plurality of the at least one functional group disposed on the surface of the core nanoparticle, the core nanoparticle exhibiting a center of the flocculant.

Embodiment 7

A method for separating bitumen from oil sands, comprising: forming a slurry comprising oil sands and water, the oil sands comprising bitumen and a solid material; contacting the slurry with flocculant particles in the presence of bubbled air to form a froth comprising the bitumen and at least an amount of the flocculant particles, each of the flocculant particles comprising a nanoparticle having at least one positively charged functional group disposed on a surface of the nanoparticle; and separating the froth from at least one other phase comprising the water and the solid material.

Embodiment 8

The method of Embodiment 7, wherein contacting the slurry with flocculant particles comprises contacting the slurry with the flocculant particles, each of the flocculant particles comprising aminated silica.

Embodiment 9

The method of any one of Embodiments 7 and 8, wherein contacting the slurry with flocculant particles comprises forming bitumen flocs comprising at least some of the bitumen and at least some of the flocculant particles, the froth comprising the bitumen flocs.

Embodiment 10

The method of Embodiment 9, wherein forming bitumen flocs comprises, for each of the bitumen flocs, agglomerating droplets of the at least some of the bitumen about the nanoparticle of each flocculant particle of the at least some of the flocculant particles.

Embodiment 11

The method of any one of Embodiments 7 through 10, wherein contacting the slurry with flocculant particles comprises forming mineral flocs comprising at least some of the solid material and at least some of the flocculant particles, the at least one other phase comprising the mineral flocs.

Embodiment 12

The method of Embodiment 11, wherein forming mineral flocs comprises, for each of the mineral flocs, agglomerating particles of the at least some of the solid material about the nanoparticle of each flocculant particle of the at least some of the flocculant particles.

Embodiment 13

A method for recovering bitumen from oil sands, comprising: agitating an aqueous mixture comprising oil sands to form a suspension comprising bitumen droplets and mineral particles suspended in water; dispersing into the suspension solid particles of a flocculant, the solid particles of the flocculant each having a core surface occupied by positively charged functional groups to neutralize a negative charge of the bitumen droplets and to form flocs comprising at least some of the bitumen droplets proximate the core surface of at least some of the solid particles of the flocculant; and bubbling a gas into the suspension to form a froth comprising the gas and the flocs.

Embodiment 14

The method of Embodiment 13, wherein dispersing into the suspension solid particles of a flocculant further comprises forming mineral flocs comprising at least some of the mineral particles proximate the core surface of at least others of the solid particles of the flocculant.

Embodiment 15

The method of Embodiment 14, further comprising separating the froth from a bottom layer comprising the mineral flocs.

Embodiment 16

The method of Embodiment 15, further comprising adding additional solid particles of the flocculant to the bottom layer.

Embodiment 17

The method of Embodiment 14, further comprising separating the froth from a bottom layer comprising the mineral flocs and from a middlings layer comprising others of the bitumen droplets and others of the mineral particles.

Embodiment 18

The method of Embodiment 17, further comprising: introducing the middlings layer to a secondary flotation cell; and dispersing into the middlings layer additional solid particles of the flocculant.

Embodiment 19

The method of any one of Embodiments 13 through 18, wherein dispersing into the suspension solid particles of a flocculant comprises dispersing into the suspension at least one of silica nanoparticles, alumina nanoparticles, titania nanoparticles, iron oxide nanoparticles, iron nitride nanoparticles, iron carbide nanoparticles, and carbon-based nanoparticles.

Embodiment 20

The method of any one of Embodiments 13 through 19, wherein dispersing into the suspension solid particles of a flocculant comprises dispersing into the suspension solid particles having the core surface occupied by at least one of primary, secondary, and tertiary amine groups, amide groups, quaternary ammonium groups, quaternary phosphonium groups, tertiary sulphonium groups, pyridinium groups, imidazolium groups, polyethylenimine (PEI) groups, and soluble polymers terminated with amine.

Although the foregoing description contains many specifics, these are not to be construed as limiting the scope of the present disclosure, but merely as providing certain embodiments. Similarly, other embodiments of the disclosed flocculants and methods may be devised that do not depart from the scope of the present disclosure. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the embodiments, as disclosed herein, which fall within the meaning and scope of the claims, are encompassed by the present disclosure.

What is claimed is:

1. A method for separating bitumen from oil sands, comprising:

forming a slurry comprising oil sands and water, the oil sands comprising bitumen and a solid material;

in a flotation cell, contacting the slurry with a solid powder of flocculant particles in the presence of bubbled air to form a froth, each of the flocculant particles comprising a nanoparticle having at least one positively charged functional group disposed on a surface of the nanoparticle; and separating the froth from at least one other phase, the froth comprising the bitumen and an amount of the flocculant particles, and the at least one other phase comprising the water, the solid material, and another amount of the flocculant particles.

2. The method of claim 1, wherein:

the nanoparticle comprises a core nanoparticle selected from the group consisting of silica nanoparticles, alumina nanoparticles, titania nanoparticles, iron oxide nanoparticles, iron nitride nanoparticles, iron carbide nanoparticles, and carbon-based nanoparticles; and the at least one positively charged functional group is disposed on a surface of the core nanoparticle.

3. The method of claim 2, wherein the core nanoparticle has a diameter of less than about 50 nm.

4. The method of claim 2, wherein the core nanoparticle is a carbon-based nanoparticle selected from the group consisting of nano-diamonds, carbon nano-tubes, fullerenes, carbon onion-like structures, graphene, and graphene oxide.

5. The method of claim 2, wherein:

the core nanoparticle is a silica nanoparticle; and the at least one positively charged functional group comprises an amine group.

6. The method of claim 2, wherein the at least one positively charged functional group comprises a plurality of the at least one positively charged functional group disposed on the surface of the core nanoparticle, the core nanoparticle exhibiting a center of the flocculant particle.

7. The method of claim 1, wherein the at least one positively charged functional group is selected from the group consisting of primary, secondary, and tertiary amine groups, amide groups, quaternary ammonium groups, quaternary phosphonium groups, tertiary sulphonium groups, pyridinium groups, imidazolium groups, polyethylenimine (PEI) groups, and soluble polymers terminated with amine.

8. The method of claim 1, wherein contacting the slurry with a solid powder of flocculant particles comprises contacting the slurry with the flocculant particles, each of the flocculant particles comprising aminated silica.

9. The method of claim 1, wherein contacting the slurry with a solid powder of flocculant particles comprises forming bitumen flocs comprising at least some of the bitumen and at least some of the amount of the flocculant particles, the froth comprising the bitumen flocs.

10. The method of claim 9, wherein forming bitumen flocs comprises, for each of the bitumen flocs, agglomerating droplets of the at least some of the bitumen about the nanoparticle of each flocculant particle of the at least some of the amount of the flocculant particles.

11. The method of claim 1, wherein contacting the slurry with a solid powder of flocculant particles comprises forming mineral flocs comprising at least some of the solid material and at least some of the another amount of the flocculant particles, the at least one other phase comprising the mineral flocs.

12. The method of claim 11, wherein forming mineral flocs comprises, for each of the mineral flocs, agglomerating particles of the at least some of the solid material about the nanoparticle of each flocculant particle of the at least some of the another amount of the flocculant particles.

13. A method for recovering bitumen from oil sands, comprising:

in a flotation cell, agitating an aqueous mixture comprising oil sands to form a suspension comprising bitumen droplets and mineral particles suspended in water;

dispersing into the suspension a powder of solid particles of a flocculant, the solid particles of the flocculant each having a nanoparticle with a core surface occupied by positively charged functional groups to neutralize a negative charge of the bitumen droplets and to form flocs comprising at least some of the bitumen droplets proximate the core surface of some of the solid particles of the flocculant;

bubbling a gas into the suspension to form a froth comprising the gas and the flocs; and separating the froth from another phase, the other phase comprising others of the solid particles of the flocculant, the water, and the mineral particles.

14. The method of claim 13, wherein dispersing into the suspension a powder of solid particles of a flocculant further comprises forming mineral flocs comprising at least some of the mineral particles proximate the core surface of at least some of the others of the solid particles of the flocculant.

15. The method of claim 14, further comprising separating the froth from the other phase in a bottom layer comprising the mineral flocs.

16. The method of claim 15, further comprising adding an additional amount of the powder of solid particles of the flocculant to the bottom layer.

17. The method of claim 14, further comprising separating the froth from the other phase in a bottom layer comprising the mineral flocs and from a middlings layer comprising others of the bitumen droplets and others of the mineral particles.

18. The method of claim 17, further comprising:

introducing the middlings layer to a secondary flotation cell; and dispersing into the middlings layer an additional amount of the powder of solid particles of the flocculant.

19. The method of claim 13, wherein dispersing into the suspension a powder of solid particles of a flocculant comprises dispersing into the suspension at least one of silica nanoparticles, alumina nanoparticles, titania nanoparticles, iron oxide nanoparticles, iron nitride nanoparticles, iron carbide nanoparticles, and carbon-based nanoparticles.

20. The method of claim 13, wherein dispersing into the suspension a powder of solid particles of a flocculant comprises dispersing into the suspension solid particles of the flocculant each having the nanoparticle with the core surface occupied by at least one of primary, secondary, and tertiary amine groups, amide groups, quaternary ammonium groups, quaternary phosphonium groups, tertiary sulphonium groups, pyridinium groups, imidazolium groups, polyethylenimine (PEI) groups, and soluble polymers terminated with amine.

* * * * *